US010385627B2

(12) United States Patent
Bailey et al.

(10) Patent No.: US 10,385,627 B2
(45) Date of Patent: Aug. 20, 2019

(54) ACTIVE WATERWAY STABILIZER

(71) Applicant: National Oilwell Varco, L.P., Houston, TX (US)

(72) Inventors: Michael J. Bailey, Rockhampton (GB); Dean Waters, Stroud (GB); Stephen Williams, Stonehouse (GB)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 15/528,180

(22) PCT Filed: Nov. 18, 2015

(86) PCT No.: PCT/US2015/061294
§ 371 (c)(1),
(2) Date: May 19, 2017

(87) PCT Pub. No.: WO2016/081573
PCT Pub. Date: May 26, 2016

(65) Prior Publication Data

US 2017/0356253 A1 Dec. 14, 2017

Related U.S. Application Data

(60) Provisional application No. 62/082,220, filed on Nov. 20, 2014.

(51) Int. Cl.
*E21B 17/10* (2006.01)
*E21B 17/042* (2006.01)

(52) U.S. Cl.
CPC ..... *E21B 17/1078* (2013.01); *E21B 17/042* (2013.01)

(58) Field of Classification Search
CPC ..... E21B 17/1078; E21B 17/042
USPC ..... 175/325.2
See application file for complete search history.

(56) References Cited

U.S. PATENT DOCUMENTS 4,141,421 A * 2/1979 Gardner ..... E21B 10/10 15/104.13
6,227,297 B1 * 5/2001 Milam ..... B08B 9/023 15/104.04
8,607,900 B1 12/2013 Smith

* cited by examiner

*Primary Examiner* — Taras P Bemko
(74) *Attorney, Agent, or Firm* — Jonathan M. Pierce; Porter Hedges LLP

(57) ABSTRACT

A downhole tool comprises a plurality of blades that extend outward from a tool body. Each blade has an under-gauge surface with a blade diameter that is less than a gauge diameter of a drill bit to be used with the downhole tool. A waterway is defined between a pair of adjacent blades and has a waterway base that is recessed from the blade diameter. One or more waterway inserts are disposed within the waterway and extend from the waterway base. Each of the one or more waterway inserts does not extend to the blade diameter. No component of the downhole tool is positioned outside the blade diameter.

20 Claims, 4 Drawing Sheets

ACTIVE WATERWAY STABILIZER

BACKGROUND

This disclosure relates generally to methods and apparatus for drilling a wellbore. More particularly, this application relates to stabilizing a drillstring in a wellbore.

In certain drilling applications, stabilizers are placed at intervals along a drillstring. Stabilizers generally include axial ribs, blades, fins, or other protrusions that maintain radial spacing between the drillstring and the wall of the wellbore. By maintaining this radial spacing, stabilizers act to, among other things, prevent differential sticking, reduce buckling, and aid in fluid circulation.

In order to maintain radial spacing while not inhibiting movement of the drillstring through the wellbore, stabilizers must be able to pass through the wellbore. Therefore, in certain embodiments, stabilizers are often sized to have a maximum outer diameter that is slightly less than the diameter of the drill bit. This condition is known as being "under-gauge." Although stabilizers that are slightly under-gauge will not contact the wellbore wall when the drill string is centered in the wellbore, as the drillstring is rotated, an under-gauge stabilizer will contact the wellbore wall.

Conventional stabilizers also feature grooves between the axial blades that provide flow channels for drilling fluid moving through the annulus between the drillstring and the wellbore. These grooves, known as "waterways," may be straight, curved, spiral, helical, or otherwise angled with respect to the centerline of the drillstring. In certain conditions, such as in horizontal wells, wellbore debris may settle and accumulate along the wellbore wall above the drill bit and stabilizers. This debris may build up below and/or above the stabilizers or in the waterways and inhibit the circulation of drilling fluid through the wellbore. To mitigate build-up of debris, the waterways are usually sized as large as feasible, preferably without edges or other asperities that may potentially capture debris flowing in the waterways.

Thus, there is a continuing need in the art for methods and apparatus for improved drillstring stabilizers that mitigate build-up of debris.

BRIEF SUMMARY OF THE DISCLOSURE

In one aspect, a downhole tool comprises a plurality of blades that extend outward from a tool body. Each blade has a gauge with a blade diameter that is less than a gauge diameter of drill bit to be used with the downhole tool. A waterway is defined between a pair of adjacent blades and has a waterway base that is recessed from the blade diameter. One or more waterway inserts are disposed within the waterway and extend from the waterway base. Each of the one or more waterway inserts does not extend to the blade diameter. No component of the downhole tool is positioned outside the blade diameter. The downhole tool may further comprise a blade insert disposed on an end of at least one of the plurality of blades. The downhole tool may further comprise a blade insert disposed on a leading edge of at least one of the plurality of blades. The under-gauge surface of at least one of the plurality of blades may be hardened. The waterway diameter may vary along the waterway. A maximum waterway diameter may be at a midpoint of the waterway. The one or more waterway inserts may be constructed from a material selected from the group consisting of: carbide, tungsten carbide, cubic boron nitride, polycrystalline diamond, and synthetic diamond. The one or more waterway inserts may be oriented to crush material between the one or more waterway inserts and a wellbore wall. The one or more waterway inserts may comprise an ultra-hard indentation surface.

In one aspect, a downhole tool comprises a tool body, a pair of blades extending from the tool body to an under-gauge surface, a waterway formed between the pair of blades, and a plurality of waterway inserts disposed within the waterway and recessed below the under-gauge surface. The waterway diameter may vary along the waterway. A maximum waterway diameter may be at a midpoint of the waterway. Each of the plurality of waterway inserts may be constructed from a material selected from the group consisting of: carbide, tungsten carbide, cubic boron nitride, polycrystalline diamond, and synthetic diamond. Each of the plurality of waterway inserts may be oriented to crush material between the waterway insert and a wellbore wall. Each of the plurality of waterway inserts may comprise an ultra-hard indentation surface.

In one aspect, a downhole tool comprises a tool body including a plurality of blades. Each of the plurality of blades extends outward from the tool body to an under-gauge surface. The downhole tool further comprises a groove defined between a pair of adjacent blades, and an insert disposed within the groove. The insert does not extend beyond the under-gauge surface. The groove may be a waterway. The insert may be oriented to crush material between the insert and a wellbore wall. The insert may comprise an ultra-hard indentation surface. The downhole tool may further comprise a blade insert disposed on a leading or trailing edge of at least one of the plurality of blades.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
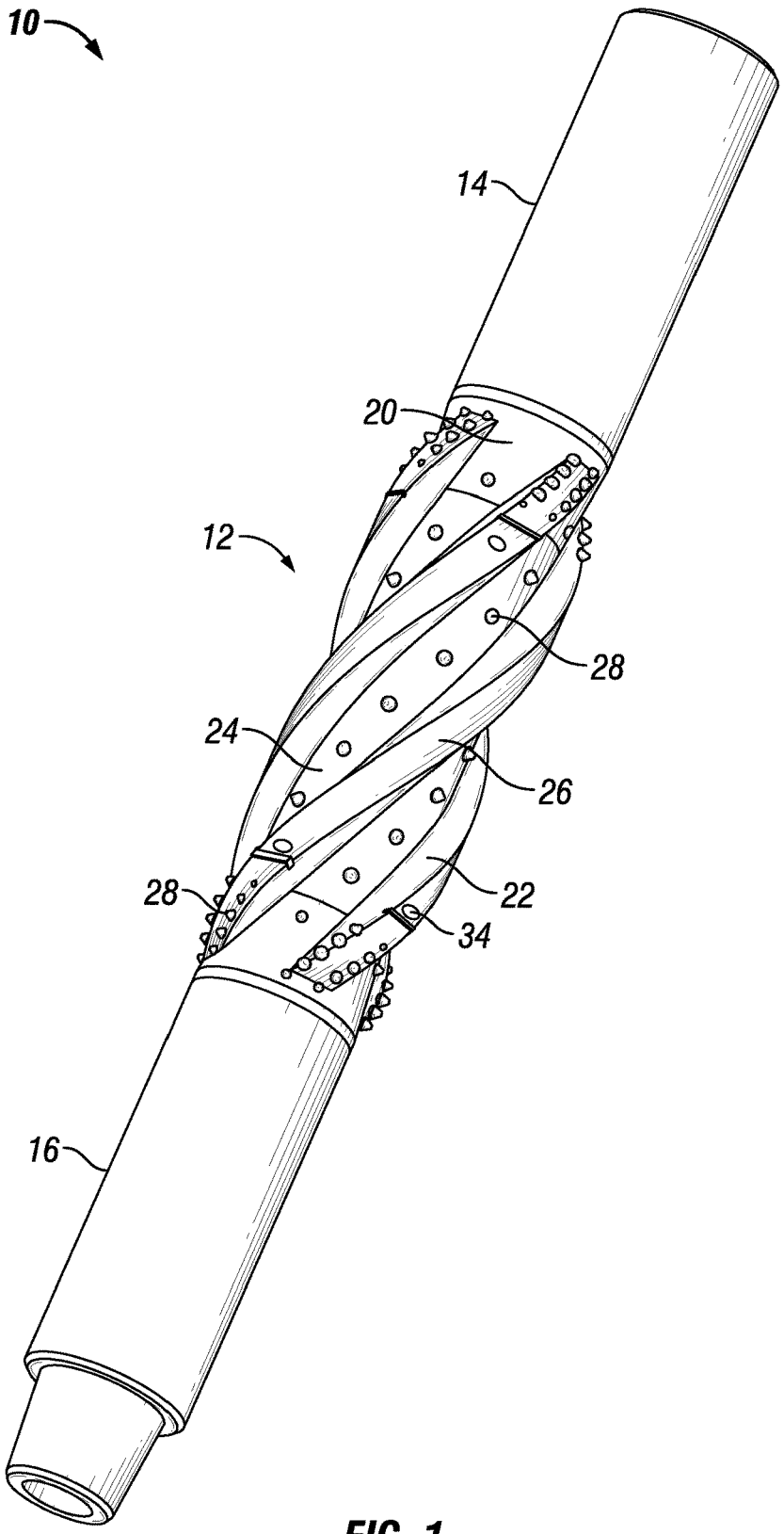
FIG. 1 is an isometric view of a drillstring stabilizer.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. As used herein a "gauge diameter" is the nominal diameter of a drill bit with which a downhole tool is designed to be used.

Referring initially to FIG. 1, a downhole tool 10 comprises a stabilizer body 12 coupled to an upper sub 14 and a lower sub 16. The upper sub 14 and the lower sub 16 provide threaded connections for coupling the downhole tool 10 to a drillstring. The stabilizer body 12 comprises a body 20 having a feedbore 21 (shown in FIGS. 4, 5 and 6), a plurality of blades 22, and a plurality of waterways 24. Each blade 22 includes an under-gauge surface 26 that has an outer diameter that is less than the gauge diameter of a drill bit to be used with the downhole tool 10. Inserts 28 are disposed at various locations both on the blades 22 and in the waterways 24 but do not project outward beyond the under-gauge surfaces 26 of the blades 22.

Figure 2:
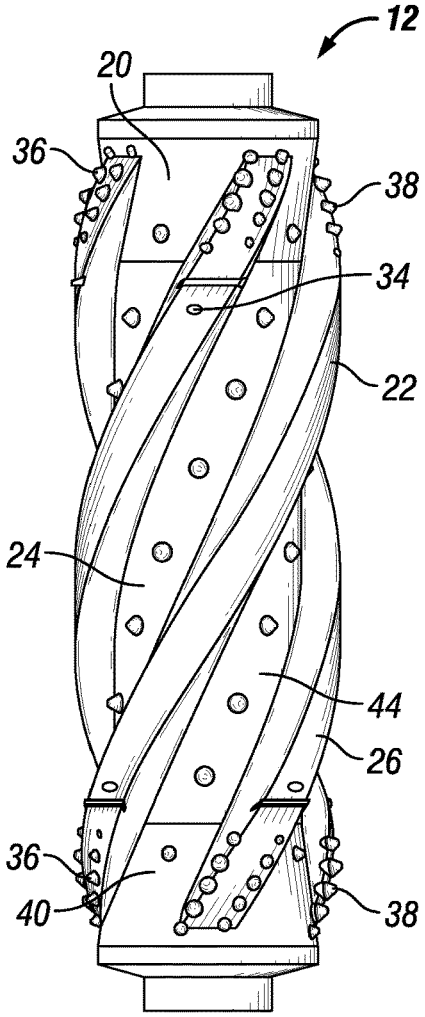
FIG. 2 is a partial front view of the drillstring stabilizer of FIG. 1.
Figure 3:
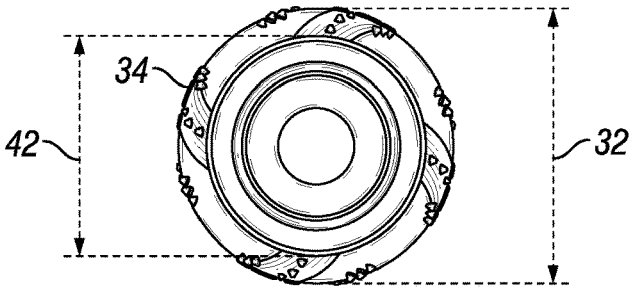
FIG. 3 is a partial end view of the drillstring stabilizer of FIG. 1.

With reference to FIGS. 2-3, each of the plurality of blades 22 has an under-gauge surface 26 with a blade diameter 32. The blade diameter 32 may vary along the length of the blade 22 but has a maximum diameter that is less than the gauge diameter of the drill bit to be used with the downhole tool 10. The under-gauge surface 26 may have a hardened outer surface or may, in certain embodiments, include hardened under-gauge inserts 34 that are flush with the under-gauge surface 26. The ends 38 of the blades 22 may taper toward the tool body 20 and may also include a plurality of blade inserts 36 that project above blade but not beyond the blade diameter 32. Some of the blade inserts 36 may be positioned in between the leading edge and the trailing edge of the blades 22 and may be oriented perpendicularly to the blade outer surface. Other blade inserts 36 may be positioned closer to the leading edge of the blades 22 and may be tilted toward the leading edge of the blade 22. In certain embodiments, under-gauge inserts 34, blade inserts 36, and portions of under-gauge surface 26 may be removable from the blade 22 to facilitate replacement of worn components or for installing components suited for a particular application. The blades 22 may also include grooves, slots, or other interruptions along the length of the blade 22.

A waterway 24 is formed between each pair of adjacent blades 22. Each waterway 24 has a waterway base surface 40 that is recessed from the blade diameter 32. The waterway base surface 40 may be defined by a waterway diameter 42 that may vary along the length of the waterway 24 but is less than the blade diameter 32. In certain embodiments, the waterway diameter 42 may gradually increase toward a maximum value at or near the longitudinal midpoint of the waterway 24. Each waterway 24 may include a plurality of waterway inserts 44 that extend above the waterway base surface 40 but not above the under-gauge surface 26. In certain embodiments, waterway inserts 44 may be removable to facilitate replacement of worn components or for installing components suited for a particular application. In general, each waterway insert 44 may be defined as having a crush diameter that is greater than the waterway diameter 42 but less than the blade diameter 32. In certain embodiments, the width of a waterway 24 may also vary over its axial length so as to direct formation materials toward one or more of the waterway inserts 44 or otherwise direct flow through the waterway 24.

Downhole tool 10 is configured so that the stabilizer body 12 acts to stabilize the tool 10 and the connected drillstring in a wellbore. Stabilizer body 12 is configured to have a maximum diameter that is smaller than the gauge diameter of the bit used to drill the wellbore so that the downhole tool 10 will provide stabilization effects without disturbing the formation surrounding the wellbore. Thus, no component of the downhole tool 10 extends to the diameter of the wellbore and preferably, no component extends beyond the blade diameter 32 which is defined by the under-gauge surface 26 of the blades 22. Further, the inserts disposed on the blades or in the waterways are not configured to cut into the wellbore but are instead oriented to crush any wellbore debris against the wellbore wall, as will be described in detail to follow.

Figure 4:
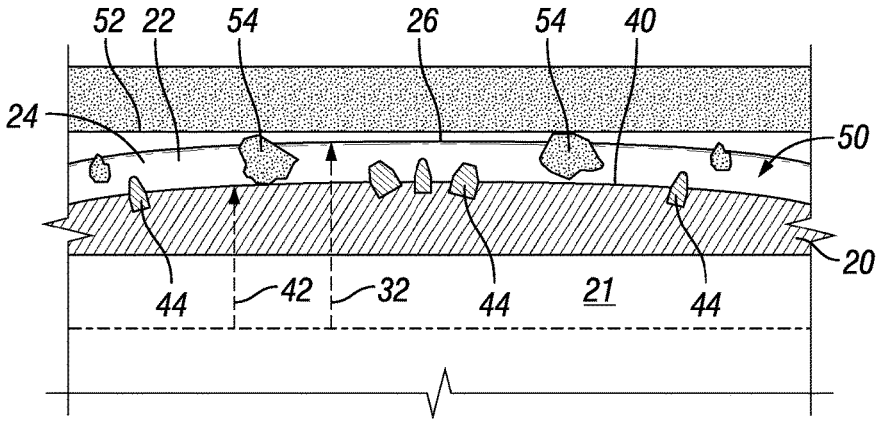
FIG. 4 is a partial sectional side view of a drillstring stabilizer.
Figure 5:
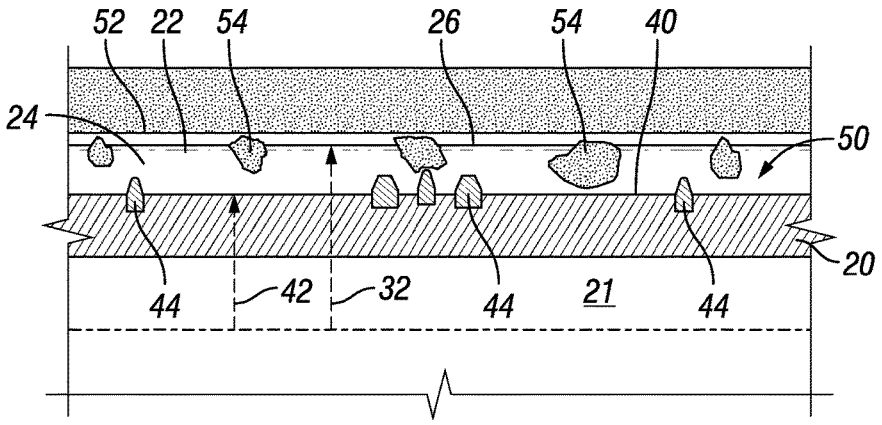
FIG. 5 is a partial sectional side view of a drillstring stabilizer.

Referring now to FIGS. 4 and 5, a longitudinal partial sectional view of a stabilizer 50 is shown within a wellbore 52. The under-gauge surface 26 of the blade 22 does not contact the wellbore 52 but will act to keep the stabilizer 50 substantially centered within the wellbore 52. Wellbore debris 54 is also present in the wellbore 52. As the wellbore debris 54 passes through the waterway 24, larger pieces of the debris 54 will be crushed between the waterway inserts 44 and the wall of the wellbore 52. This will break the debris 54 into smaller pieces, which will reduce the likelihood of the debris 54 inhibiting flow through the wellbore 52. FIG. 4 also illustrates a waterway diameter 42 that is variable over the length of the waterway 24 with the largest waterway diameter 42 near the middle of the stabilizer 50 and gradually decreasing toward the ends of the stabilizer 50. FIG. 5 illustrates a waterway diameter 42 that is constant over the length of the waterway 24.

Figure 6:
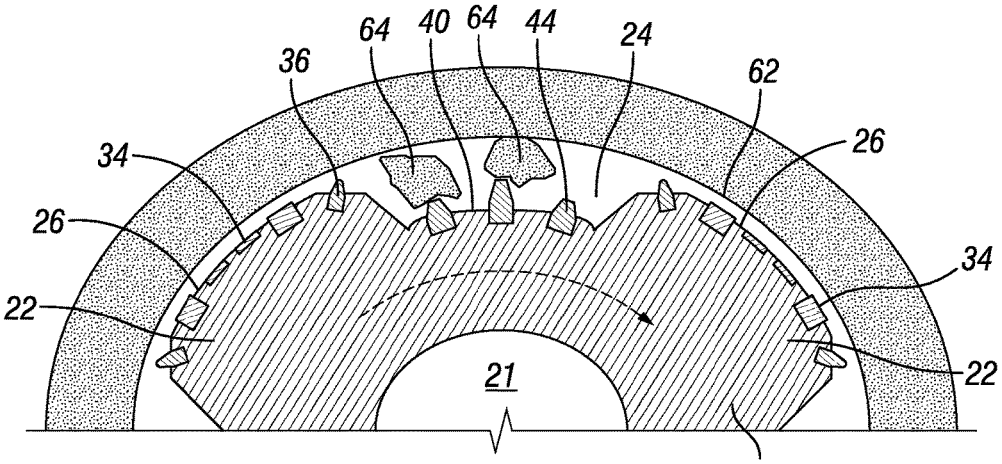
FIG. 6 is a partial sectional end view of a drillstring stabilizer.

Referring now to FIG. 6, a partial sectional end view of a stabilizer 60 disposed within a wellbore 62, wellbore debris 64 is shown within waterway 24 in contact with waterway inserts 44. Blades 22 are shown having under-gauge inserts 34 on the under-gauge surface 26 as well as blade inserts 36 on the leading and trailing edges of the blade 22. Under-gauge inserts 34 are configured to reinforce the under-gauge surface 26 and are therefore substantially flush with the under-gauge surface 26. The under-gauge inserts 34 are not intended to cut or disturb the wellbore 62. Blade inserts 36 project above the blade 22 but do not project beyond the under-gauge surface 26. Blade inserts 36 act to crush any debris 64 that may move between the blade 22 and the wall of the wellbore 62. Some blade inserts 36 may be positioned closer to the leading edge of the blades 22 and may be tilted toward the leading edge of the blade 22. Other blade inserts 36 may be positioned closer to the trailing edge of the blades 22 and may be tilted toward the trailing edge of the blade 22.

Figure 7:
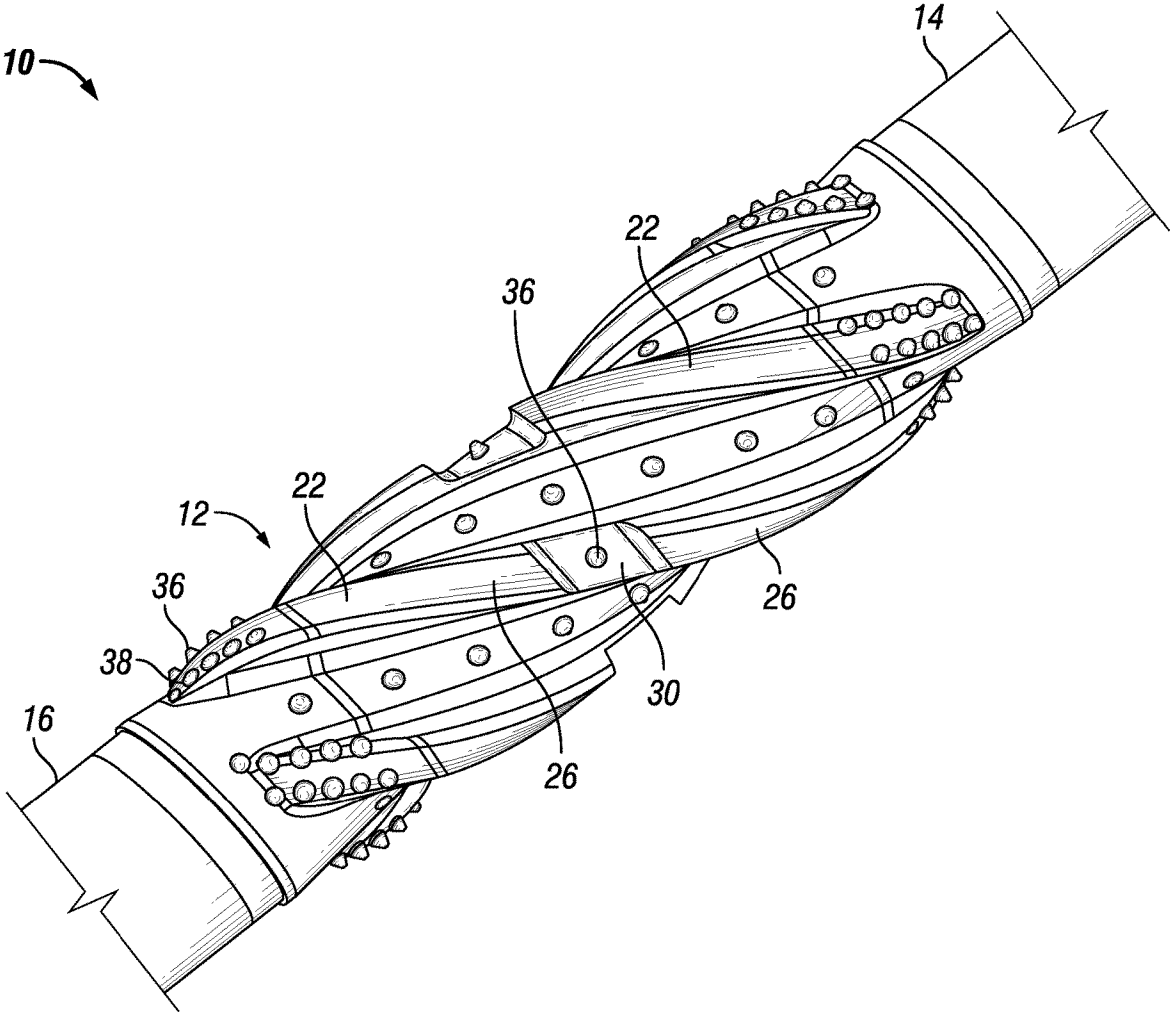
FIG. 7 is a partial isometric view of a drillstring stabilizer.

Referring now to FIG. 7, the blades 22 include grooves, slots, or other interruptions along the length of a pair of adjacent blades 22. For example a groove 30 may be formed a pair of adjacent blades 22. The pair of adjacent blades 22 may have substantially the same length. The groove 30 includes one or more blade insert 36 that projects above a groove base surface but not beyond the blade diameter 32 or beyond the under-gauge surfaces 26 of the adjacent blades 22. The one or more blade insert 36 may be positioned in between the leading edge and the trailing edge of the blades 22 and may be oriented perpendicularly to the blade outer surface.

The downhole tool 10 may be used to pulverize, or crush, debris within a vertical well or a deviated well, and in particular for pulverizing debris on the low side of a deviated well. As the downhole tool 10 moves through the wellbore, debris that may become trapped within a waterway 24 or between the wall of the wellbore and the blades 22 will be pulverized by a combination of the rotation and weight of the downhole tool 10.

The waterway inserts 44, blade inserts 36, and under-gauge inserts 34 may be constructed from any hardened material. In certain embodiments any of the inserts may be formed from carbide, tungsten carbide, cubic boron nitride, polycrystalline diamond, synthetic diamond, and other material suitable for crushing wellbore debris. The inserts may be conical, cylindrical, rectangular, or may have any other shape that may be suitable such as chisel-shaped. The waterway inserts 44 and blade inserts 36 preferably comprise an ultra-hard indentation surface. The under-gauge inserts 34 preferably comprise an ultra-hard flat surface.

In certain embodiments, the inserts may be used in addition to polycrystalline diamond cutters or any other component suitable for crushing or cutting formation materials, such as roller cones. For example, the downhole tool 10 may optionally include one or more reaming blades disposed around the downhole tool 10.

In certain embodiments, the downhole tool 10 may be configured for use with wired drill pipe. Wired drill pipe is similar to conventional drill pipe but includes wires, cables, or other conduits for the transmission of data between downhole sensors and the drilling rig. The downhole tool 10 may be fitted with any number of downhole sensors, such as temperature or pressure sensors, that can transmit data via wired drill pipe to the drilling rig.

In certain embodiments, the downhole tool 10 may be configured as an active stabilizer, and the stabilizer blades, or portion thereof, may be extended or retracted within the body of the downhole tool 10.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A downhole tool comprising:

a tool body;

a plurality of blades that extend outward from the tool body, wherein each blade has an under-gauge surface with a blade diameter that is less than a gauge diameter of a drill bit to be used with the downhole tool;

a waterway defined between a pair of adjacent blades, wherein the waterway has a waterway base that is recessed from the blade diameter; and one or more waterway inserts configured to crush material between the one or more waterway inserts and a wellbore wall, the one or more waterway inserts being disposed within the waterway and extending from the waterway base, wherein each of the one or more waterway inserts does not extend to the blade diameter, and wherein no component of the downhole tool is positioned outside the blade diameter, wherein the one or more waterway inserts comprise an ultra-hard indentation surface.

2. The downhole tool of claim 1, further comprising a blade insert disposed on an end of at least one of the plurality of blades.

3. The downhole tool of claim 1, further comprising a blade insert disposed on a leading or trailing edge of at least one of the plurality of blades.

4. The downhole tool of claim 1, wherein the under-gauge surface of at least one of the plurality of blades is hardened.

5. The downhole tool of claim 1, wherein a waterway diameter varies along the waterway.

6. The downhole tool of claim 5, wherein a maximum waterway diameter is at a midpoint of the waterway.

7. The downhole tool of claim 1, wherein the one or more waterway inserts are constructed from a material selected from the group consisting of: carbide, tungsten carbide, cubic boron nitride, polycrystalline diamond, and synthetic diamond.

8. The downhole tool of claim 1, wherein the one or more waterway inserts are oriented to crush material between the one or more waterway inserts and a wellbore wall.

9. The downhole tool of claim 1 wherein each of the one or more waterway inserts is partially embedded into the tool body.

10. A downhole tool comprising:

a tool body;

a pair of blades extending from the tool body to a surface;

a waterway formed between the pair of blades; and a plurality of waterway inserts each configured to break debris into smaller pieces, each of the plurality of waterway inserts being disposed within the waterway and remaining recessed below the surface, wherein each of the plurality of waterway inserts comprises an ultra-hard indentation surface.

11. The downhole tool of claim 10, wherein a waterway diameter varies along the waterway.

12. The downhole tool of claim 11, wherein a maximum waterway diameter is at a midpoint of the waterway.

13. The downhole tool of claim 10, wherein each of the plurality of waterway inserts is constructed from a material selected from the group consisting of: carbide, tungsten carbide, cubic boron nitride, polycrystalline diamond, and synthetic diamond.

14. The downhole tool of claim 10, wherein each of the plurality of waterway inserts is oriented to crush material between the waterway insert and a wellbore wall.

15. The downhole tool of claim 10 wherein each of the plurality of waterway inserts is partially embedded into the tool body.

16. A downhole tool comprising:

a tool body including a plurality of blades, wherein each of the plurality of blades extends outward from the tool body to a surface;

a groove defined between a pair of adjacent blades; and an insert configured to pulverize debris trapped between a wellbore wall and the insert by a combination of the rotation and weight of the downhole tool, the insert being disposed within the groove, wherein the insert does not extend beyond the surface, wherein the insert comprises an ultra-hard indentation surface.

17. The downhole tool of claim 16, wherein the groove is a waterway.

18. The downhole tool of claim 16, wherein the insert is oriented to crush material between the insert and a wellbore wall.

19. The downhole tool of claim 16 further comprising a blade insert disposed on a leading or trailing edge of at least one of the plurality of blades.

20. The downhole tool of claim 16 wherein the insert is partially embedded into the tool body.

* * * * *